US008960823B2

(12) United States Patent
Golias et al.

(10) Patent No.: US 8,960,823 B2
(45) Date of Patent: Feb. 24, 2015

(54) REINFORCEMENT RIB FOR SHELVING

(75) Inventors: Robert J. Golias, Solon, OH (US); Gary W. James, Parma Heights, OH (US); Gary R. Kish, Parma, OH (US); Bernard J. Golias, Jr., Twinsburg, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 120 days.

(21) Appl. No.: 12/860,263

(22) Filed: Aug. 20, 2010

(65) Prior Publication Data

US 2011/0215693 A1 Sep. 8, 2011

Related U.S. Application Data

(60) Provisional application No. 61/353,011, filed on Jun. 9, 2010, provisional application No. 61/310,009, filed on Mar. 3, 2010.

(51) Int. Cl.
*A47B 88/00* (2006.01)
*A47B 96/02* (2006.01)

(52) U.S. Cl.
CPC ..... *A47B 96/02* (2013.01)
USPC ..... 312/348.4; 312/330.1; 220/23.88

(58) Field of Classification Search
CPC .... A47B 45/00; A47B 47/00; A47B 47/0075; A47B 47/02; A47B 55/00; A47B 67/04; A47B 88/0003; A47B 88/0014; A47B 88/0051; A47B 88/0455; A47B 96/02; A47B 2210/0024; A47B 2210/0059; B65D 1/42; B65D 19/38; B65D 2519/00024; B65D 2519/00059; B65D 2519/00164
USPC ..... 312/330.1, 348.1, 348.4, 257.1; 211/11, 211/126.2, 133.6; 220/23.83, 23.87–23.89, 220/656–659, 639, 640
See application file for complete search history.

(56) References Cited

U.S. PATENT DOCUMENTS

| | | | | |
|---|---|---|---|---|
| 2,701,174 | A * | 2/1955 | Franks | 312/263 |
| 3,273,952 | A * | 9/1966 | Himelreich et al. | 312/348.1 |
| 3,688,803 | A * | 9/1972 | Pavia et al. | 138/173 |
| 3,784,274 | A * | 1/1974 | Holmes et al. | 312/330.1 |
| 3,870,188 | A * | 3/1975 | Buffett | 220/675 |
| 3,890,024 | A * | 6/1975 | Noneman et al. | 312/334.28 |
| 4,244,075 | A * | 1/1981 | Silver | 15/145 |
| 4,662,532 | A * | 5/1987 | Anderson et al. | 220/7 |
| 4,732,430 | A * | 3/1988 | Byrns | 312/330.1 |
| 4,887,874 | A * | 12/1989 | Joffe | 312/258 |
| 5,236,109 | A * | 8/1993 | Zuckerman | 223/96 |
| 5,433,516 | A * | 7/1995 | Beals et al. | 312/257.1 |
| 5,906,422 | A * | 5/1999 | Golias, Sr. | 312/334.7 |
| 6,015,053 | A * | 1/2000 | Sheng | 211/188 |
| 6,079,803 | A * | 6/2000 | West et al. | 312/107 |
| 6,193,340 | B1 * | 2/2001 | Schenker et al. | 312/265.5 |
| 2003/0030353 | A1 * | 2/2003 | Remmers | 312/334.7 |
| 2003/0034719 | A1 * | 2/2003 | Li | 312/330.1 |
| 2008/0128319 | A1 * | 6/2008 | Colin et al. | 206/745 |

* cited by examiner

*Primary Examiner* — Darnell Jayne
*Assistant Examiner* — Ryan A Doyle
(74) *Attorney, Agent, or Firm* — Fay Sharpe LLP; James E. Scarbrough

(57) ABSTRACT

A cabinet includes a pair of side walls; a rear wall connected to the pair of side walls; a top wall connected to the pair of side walls and the rear wall; and a slidable tray which slides between the pair of side walls. The tray includes a front wall, a pair of side walls, a rear wall, and a bottom wall connecting the front wall, the pair of side walls, and the rear wall. A first reinforcement member extends across the front wall. The reinforcement member includes a raised wall extending from the front wall.

10 Claims, 9 Drawing Sheets

REINFORCEMENT RIB FOR SHELVING

CLAIM OF PRIORITY

This application claims priority from U.S. Provisional Patent Application Ser. No. 61/353,011 filed on Jun. 9, 2010 and U.S. Provisional Patent Application Ser. No. 61/310,009 filed on Mar. 3, 2010, both of which are incorporated herein in their entirety.

BACKGROUND OF THE DISCLOSURE

The disclosure generally relates to slidable drawers or shelves in metal cabinets or storage bins. Alternatively, the disclosure may also relate to non-sliding shelves in metal cabinets. More particularly, the disclosure relates to reinforcement members or ribs for shelves or drawers of metal cabinets.

Metal cabinets are some of the most versatile pieces of furniture available. Metal cabinets can be hung in work areas such as metal or woodworking shops, garages, as well as many other places. Metal cabinets can also provide storage in vehicles such as trucks and vans. In addition to the versatility provided by metal cabinets regarding the location and placement of the cabinets, metal cabinets also provide versatility in what they store. Metal cabinets have been used to store threaded rod, wire, brake line, welding rods, as well as more common items such as tools and fasteners. Metal cabinets also include slidably or fixedly mounted shelves and drawers, which add to the versatility of the cabinets.

The present disclosure relates generally to storage cabinets and the like, and more particularly to reinforcement ribs for a shelf or a drawer of a storage cabinet which receives sliding drawers, trays or shelves.

With reference now to FIG. 1, it is generally known to provide a cabinet structure A into which one or more sliding drawers or shelves B are received. The cabinet has a top wall 1 and parallel side walls 2, 3, which form an enclosure into which the drawers or shelves extend. In certain applications, the drawers are compartmentalized or otherwise configured to hold screws, nuts, bolts, and other articles. For example, a compartmentalized storage box may be adapted to rest on a cabinet drawer B. The storage of such articles in this manner oftentimes leads to the drawers B being heavily loaded. The drawer or shelf may become bowed or bent due to excess loading which may make it difficult to slide the drawer. As such, the drawers and the cabinet structure, including a conventional slide rack mounted to side wall via mounting structure, must be sufficiently strong to withstand the weight. Of course, the cabinet must also be affordable and preferably relatively easy to move about. Another problem with existing drawers or shelves is that if they become overloaded, they may "oil can" or bend, crease or bow under load stresses.

Thus, there has been found a need for a cabinet shelving structure which provides reinforcement of the drawers or shelves that overcomes the above-noted deficiencies and others while also providing a low-cost and easily assembled structure.

SUMMARY OF THE DISCLOSURE

In accordance with one aspect of the present disclosure, a cabinet structure A includes slide rack panels which can be positioned respectively on opposite left and right lateral sides of the cabinet. Drawer support rails are connected to the left and right side panels. Each of the rails is positioned in support rail receiving notches or openings within the panels and generally horizontally extends from a cabinet front region to a cabinet rear region when installed. A drawer or shelf B is then movably or slidably connected to the drawer support rails and moves or slides between an open position extending from the cabinet and a closed position within said cabinet.

In accordance with another aspect of the disclosure, a cabinet includes a pair of side walls; a rear wall connected to the pair of side walls; a top wall connected to the pair of side walls and the rear wall; a slidable tray which slides between the pair of side walls; the tray including a front wall, a pair of side walls, a rear wall, and a bottom wall including the front wall, the pair of side walls, and the rear wall.

The front wall includes a first reinforcement member extending across the front wall. The first reinforcement member includes a raised wall extending from the front wall.

In accordance with another aspect of the disclosure, a tray for use in a metal cabinet includes a front wall; a rear wall extending parallel to the front wall; and a pair of side walls extending between the front and rear walls. The side walls are parallel to each other. A bottom wall extends between the front wall and the rear wall.

A reinforcement rib is formed on an outer surface of the front wall.

The rib includes at least one wall protruding outwardly from the outer surface of the front wall.

In accordance with another aspect of the disclosure, the drawer B has one or more reinforcement ribs C formed or embossed in a front or rear wall of the drawer or shelf.

Another aspect of the disclosure is the ribs can be elongated and/or angled.

Another aspect of the disclosure is a rib which has rounded edges, angled or tapered edges or flat or square shaped edges.

Another aspect of the disclosure is ribs which are curved or semi-circular in shape along the longitudinal length of the ribs.

Another aspect of the disclosure is ribs which are angled or triangular in shape across the longitudinal length of the ribs.

Another aspect of the disclosure is ribs which are square in shape across the longitudinal length of the ribs.

Another aspect of the disclosure is a front wall which has ears or extensions formed on opposite ends for additional reinforcement.

Another aspect of the disclosure is a reinforcement rib which has dimples formed therein.

Another aspect of the disclosure is ribs which are formed on a front wall and a bottom wall for additional reinforcement.

Another aspect of the present disclosure is that the shelves are easily manufactured and cost-effective.

Still another aspect of the present disclosure is that the reinforcement ribs add rigidity and strength to the drawer or shelf walls to prevent "oil canning" or bending, creasing or bowing of the shelf or drawer.

Still other benefits and aspects of the present disclosure will become apparent to those of ordinary skill in the art upon reading and understanding the following detailed description of the preferred embodiment.

BRIEF DESCRIPTION OF THE DRAWINGS

The disclosure may take physical form in certain parts and arrangements of parts, an embodiment of which will be described in detail in this specification and illustrated in the accompanying drawings which form a part hereof.

DETAILED DESCRIPTION OF THE INVENTION

Figure 1:
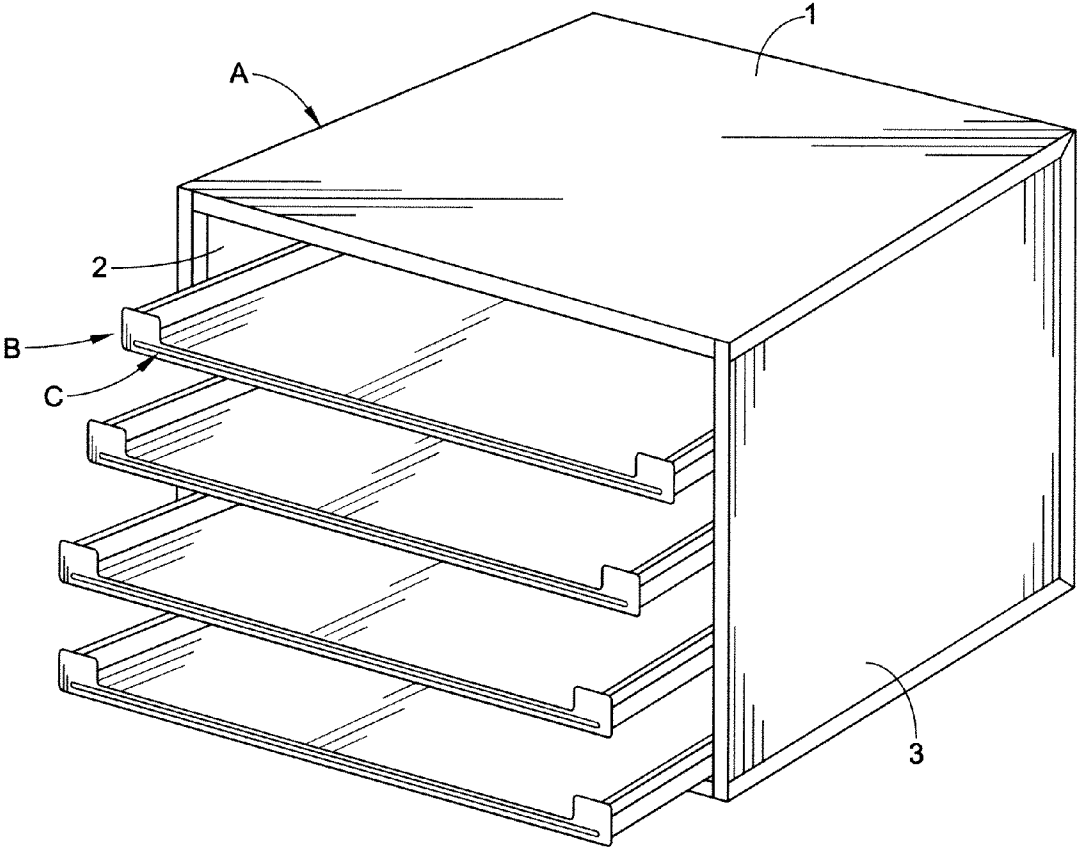
FIG. 1 is a perspective view of an existing cabinet having slidable drawers or shelves therein.
Figure 2:
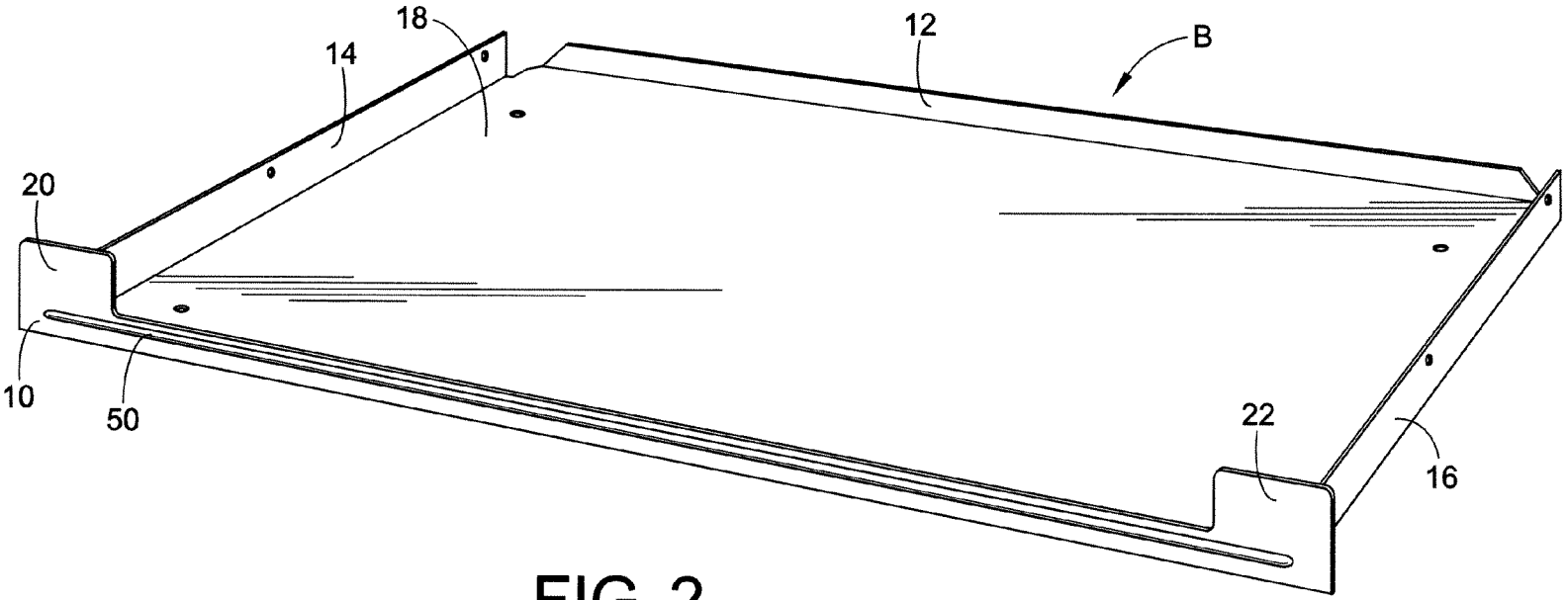
FIG. 2 is a perspective view of a slidable drawer or shelf having an elongated reinforcement rib formed on a front wall thereof.

Referring now to FIG. 2, a metal shelf, tray or drawer B is shown. The drawer has a front wall 10, a rear wall 12 parallel to the front wall, and two side walls 14, 16 parallel to each other and perpendicular to the front and rear walls. A substantially flat bottom wall 18 extends between the front, rear and side walls.

Front wall 10 can have raised end portions or ears 20, 22 on opposite ends. The ears 20, 22 serve an aesthetic purpose to hide the roller racks and also provide additional rigidity to the front wall. Alternatively, the ears are not provided on the front wall.

Figure 3:
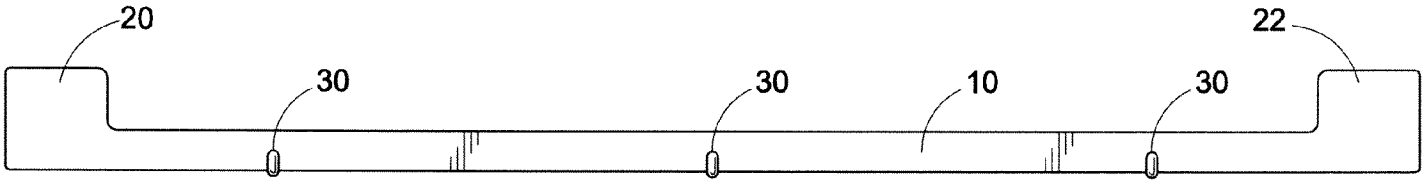
FIG. 3 is a front elevational view of the drawer of FIG. 2 having spaced apart reinforcement ribs on a front wall in accordance with another aspect of the disclosure.

Referring now to FIG. 3, a first embodiment of the present disclosure is shown. Several impressions or beads or ribs 30 are formed or embossed in the material of the shelf or drawer front wall 10. The beads are approximately equally spaced apart and are about ⅛-inch wide and about ⅛-inch deep; although other dimensions and spacings are contemplated by the disclosure. The ribs serve to add strength, stiffness and rigidity to the front wall, as well as the entire drawer. The ribs aid the drawer in withstanding load or bending stresses. Drawers are subjected to bending or creasing or bowing or "oil canning." The ribs help minimize the effects of these stresses.

Figure 3A:
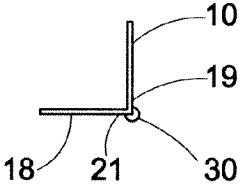
FIG. 3A is a side elevational view of a rib of FIG. 3.

As seen in FIG. 3A, the bead or rib 30 can have a smooth radius which extends from a bottom end 19 of the front wall 10 to an outer end 21 of the bottom wall 18. Alternatively, the rib can have a rough or dimpled configuration.

Figure 4:
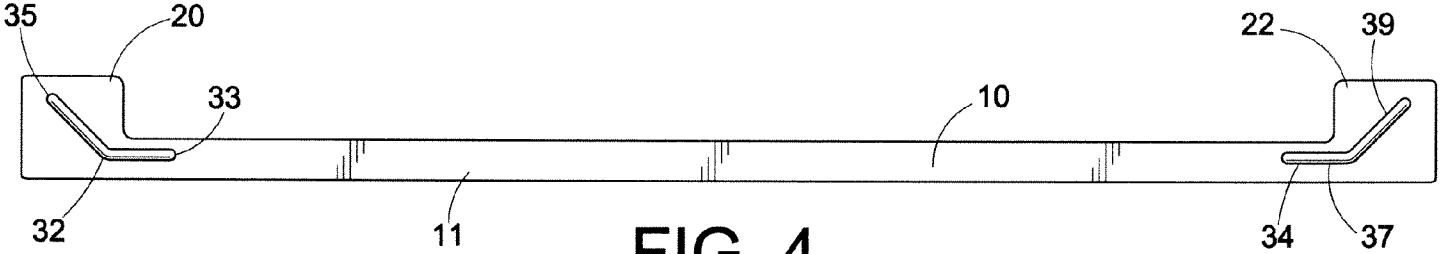
FIG. 4 is a front elevational view of a drawer with angled reinforcement ribs on a front wall in accordance with another aspect of the present disclosure.

Referring now to FIG. 4, a pair of angled ribs 32, 34 are formed in the ears 20, 22 of the front wall 10 in accordance with another embodiment of the disclosure. Rib 32 has a horizontal portion 33 and an angled or radiused portion 35 extending therefrom. Similarly, rib 34 has a horizontal portion 37 and an angled or radiused portion 39 extending therefrom. Portions 35, 39 extend in opposite directions on face 11 of the front wall. The ribs are embossed in the ears 20, 22 and are about ⅛-inch deep and about ⅛-inch wide or thick, and have various lengths and angles, such as 45 degrees or so. These ribs also serve to prevent or minimize bending or bowing of the front wall.

Figure 5:
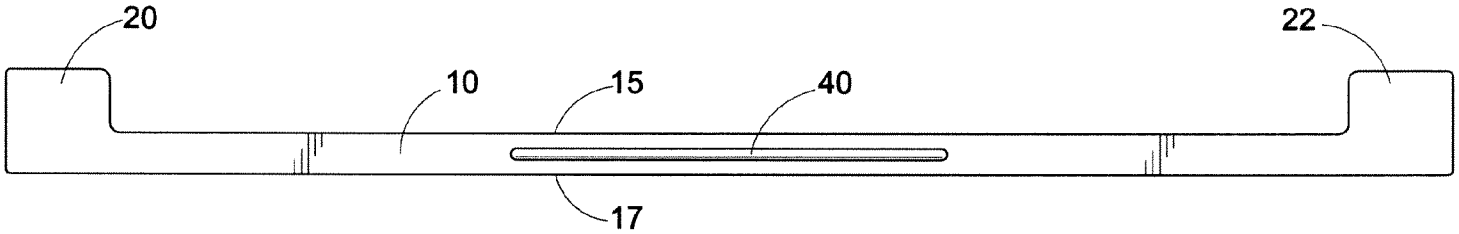
FIG. 5 is a front elevational view of a drawer with a short elongated reinforcement rib on a front wall in accordance with another embodiment of the present disclosure.

Referring now to FIG. 5, a single elongated bead or rib 40 is centrally positioned on front wall 10 in accordance with another embodiment of the disclosure. The rib is shown to be of a short length, and is also about ⅛-inch deep and about ⅛-inch thick or wide. Rib 40 can also be embossed or impressed in rear wall 12 as well. Rib 40 can extend about one-third or more of the longitudinal length of the wall 10. Rib 40 is also centered between top and bottom ends 15, 17 of wall 10.

Figure 6:
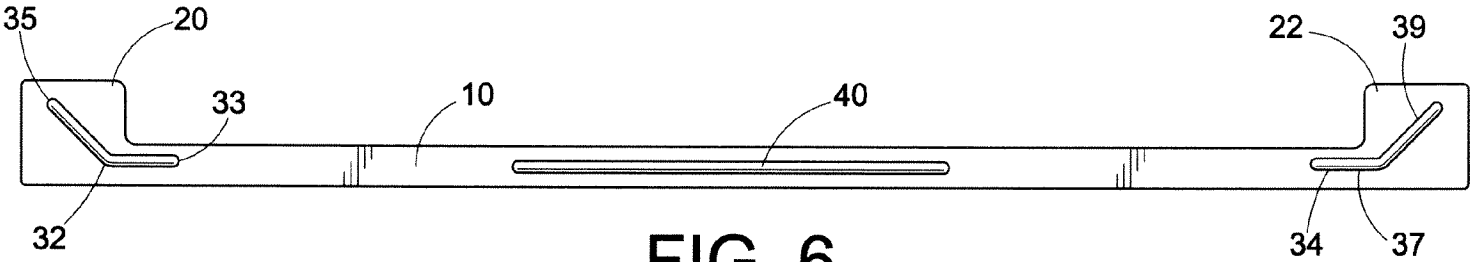
FIG. 6 is a front elevational view of a drawer with angled ribs and an elongated rib on a front wall in accordance with another aspect of the present disclosure.

Referring now to FIG. 6, in accordance with another embodiment of the disclosure, the single rib or bead 40 of FIG. 5 is shown with two additional angled or radiused ribs 32, 34, such as previously shown in FIG. 4.

Figure 7:
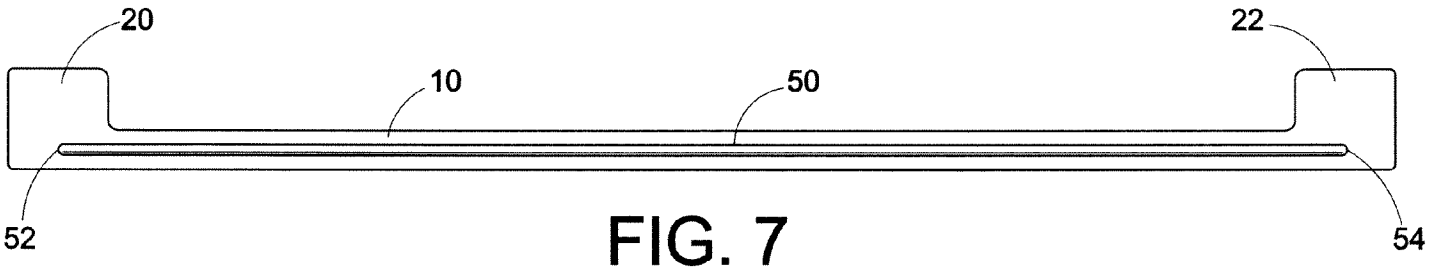
FIG. 7 is a front elevational view of a drawer with a long elongated rib on a front wall in accordance with another embodiment of the present disclosure.

Referring now to FIGS. 2 and 7, in accordance with another embodiment of the disclosure, a single long length elongated rib or bead 50 extends along substantially the entire longitudinal length of the front wall 10. Rib 50 is also about ⅛-inch deep by about ⅛-inch thick or wide but can be other dimensions as well. Rib 50 can also be embossed or impressed in the rear wall 12 as well. Rib 50 has a curved or semi-circular conformation along its longitudinal length and also has curved opposite ends 52, 54 which are formed in ears 20, 22. The rib wall has a radius of about ⅛ inches.

Figure 8:
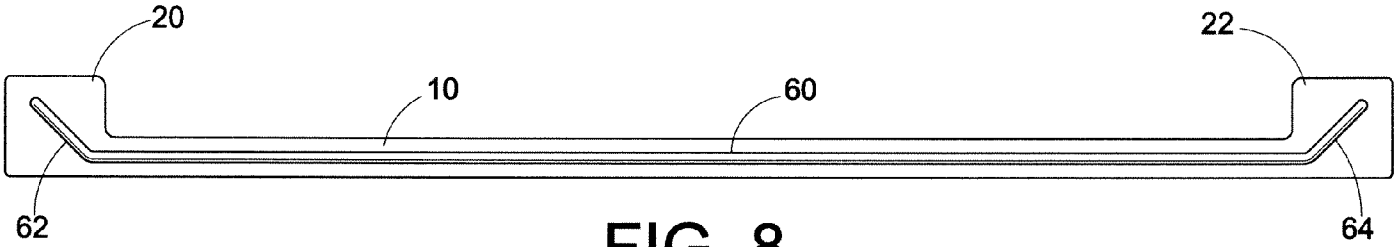
FIG. 8 is a front elevational view of a drawer with a long elongated rib with angled end portions on a front wall in accordance with another embodiment of the present disclosure.

Referring now to FIG. 8, in accordance with another aspect of the disclosure, a single elongated bead 60 extends along substantially the entire longitudinal length of front wall 10. Bead 60 has two angled or radiused portions 62, 64 (at an angle of about 45 degrees or so) extending from opposite ends of the rib which are formed on ears 20, 22. Rib 60 is also about ⅛-inch deep by about ⅛-inch thick or wide.

Figure 9:
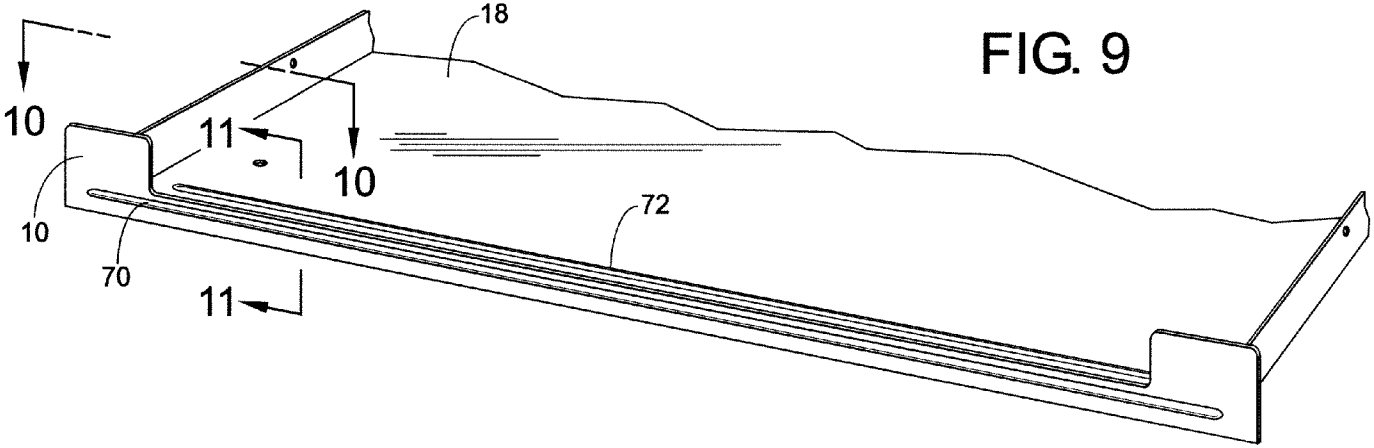
FIG. 9 is a perspective view of an alternate embodiment of the present disclosure with a second reinforcement rib formed on the bottom wall of the tray.
Figure 11:
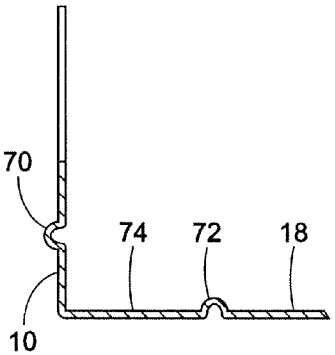
FIG. 11 is a cross-sectional view taken along lines 11-11 of FIG. 9.
Figure 10:
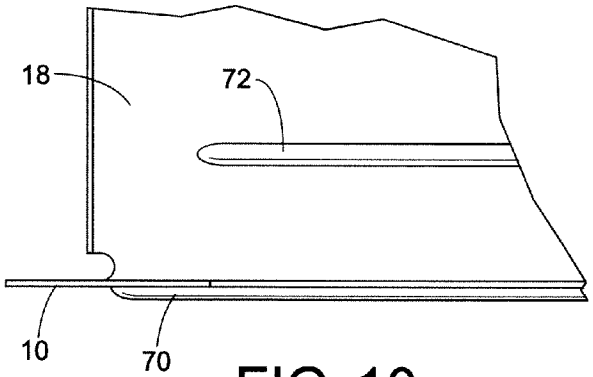
FIG. 10 is a top plan view along lines 10-10 of FIG. 9.

Referring now to FIGS. 9, 10 and 11, in accordance with another aspect of the disclosure, a pair of reinforcement ribs 70, 72 are shown with front rib 70 positioned on the front wall 10 and second rib 72 formed on bottom wall 18. Each rib 70, 72 has a rounded or curved conformation along their longitudinal length as clearly shown in FIG. 11. Ribs 70, 72 are substantially parallel to each other along their longitudinal length and are roughly the same longitudinal length, width and depth. Rib 72 serves to add additional rigidity to the bottom wall of the tray.

In FIG. 11, the raised portion of rib 72 extends above a top surface 74 of bottom wall 18 and the raised portion of rib 70 extends outwardly of front wall 10.

Figure 12:
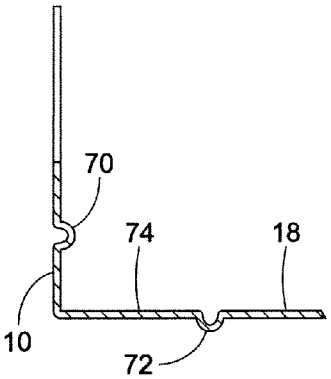
FIG. 12 is a cross-sectional view of an alternate embodiment of the present disclosure having a second reinforcement rib formed on a bottom wall of the tray.

Referring to FIG. 12, in accordance with another aspect of the disclosure, ribs 70 and 72 extend into wall 10 and below the top surface 74 of bottom wall 18. However, different combinations of the ribs of FIGS. 11 and 12 are also contemplated by the disclosure.

Rib 72 can also be formed or embossed in bottom wall 18 extending diagonally between front wall 10 and rear wall 12 to further reduce or prevent "oil canning" or bowing of the drawer. Also, the ribs are shown to be embossed or formed in the walls of the drawer or shelf; however, the ribs are contemplated to alternatively be welded or otherwise secured to the walls as well. Thicknesses, widths, depths and lengths can vary from those shown in the disclosure without departing from the scope of the disclosure.

Figure 13:
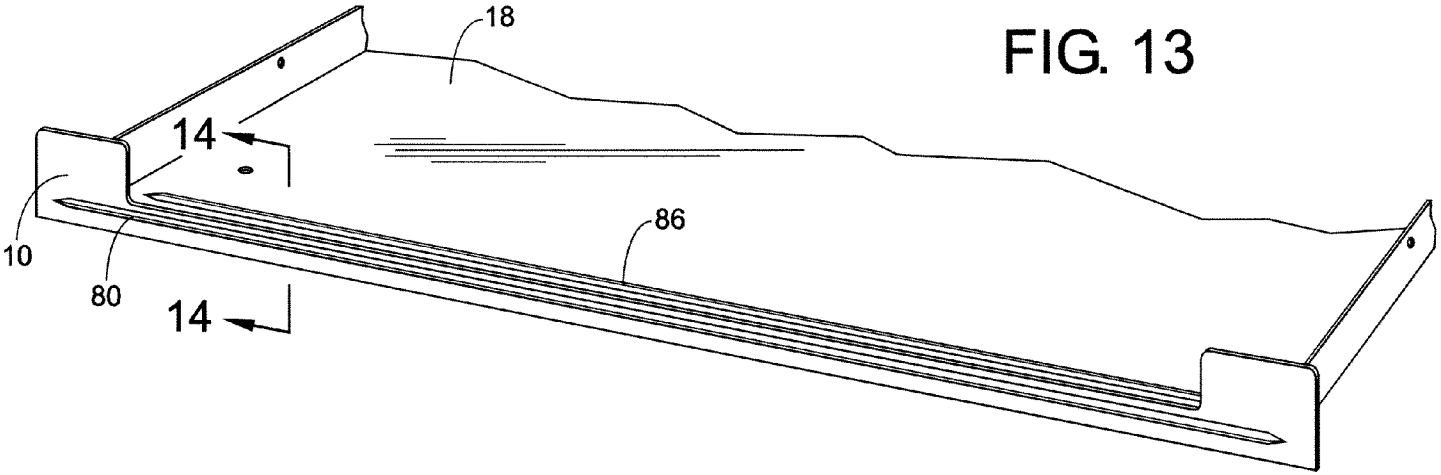
FIG. 13 is a front perspective view of an alternate embodiment of the drawer having an angled reinforcement rib on a front wall and bottom wall of the drawer.
Figure 14:
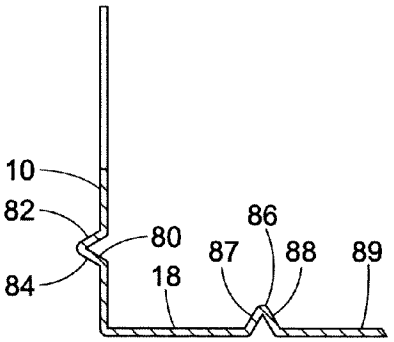
FIG. 14 is a cross-sectional view along lines 14-14 of FIG. 13.

Referring now to FIGS. 13 and 14, in accordance with another aspect of the disclosure, an angled or tapered rib 80 is formed along the longitudinal length of front wall 10. Angled rib 80 has a triangular shape or appearance formed by walls 82, 84 clearly shown in FIG. 14. Rib 80 extends outwardly of wall 10. A second rib 86, substantially parallel to the front rib 80, can also be formed in bottom wall 18 and have a triangular shape or appearance formed by walls 87, 88. In FIG. 14, the angled rib 86 extends above top surface 89 of bottom wall 18. Each angled wall is formed at about a 45 degree angle.

Figure 15:
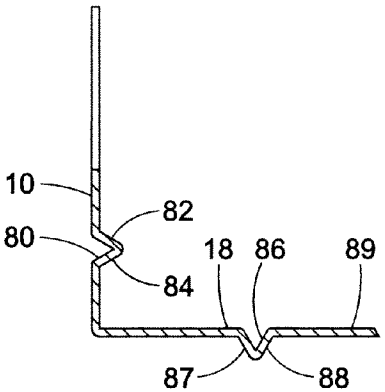
FIG. 15 is a cross-sectional view of an alternate embodiment of the shelf with angled reinforcement ribs.

Referring to FIG. 15, in accordance with another aspect of the disclosure, rib 86 can extend below the top surface 89 of bottom wall 18, and rib 80 extends inwardly with respect to wall 10. Any combination of the ribs 80, 86 shown in FIGS. 14 and 15 is contemplated by the disclosure.

Figure 16:
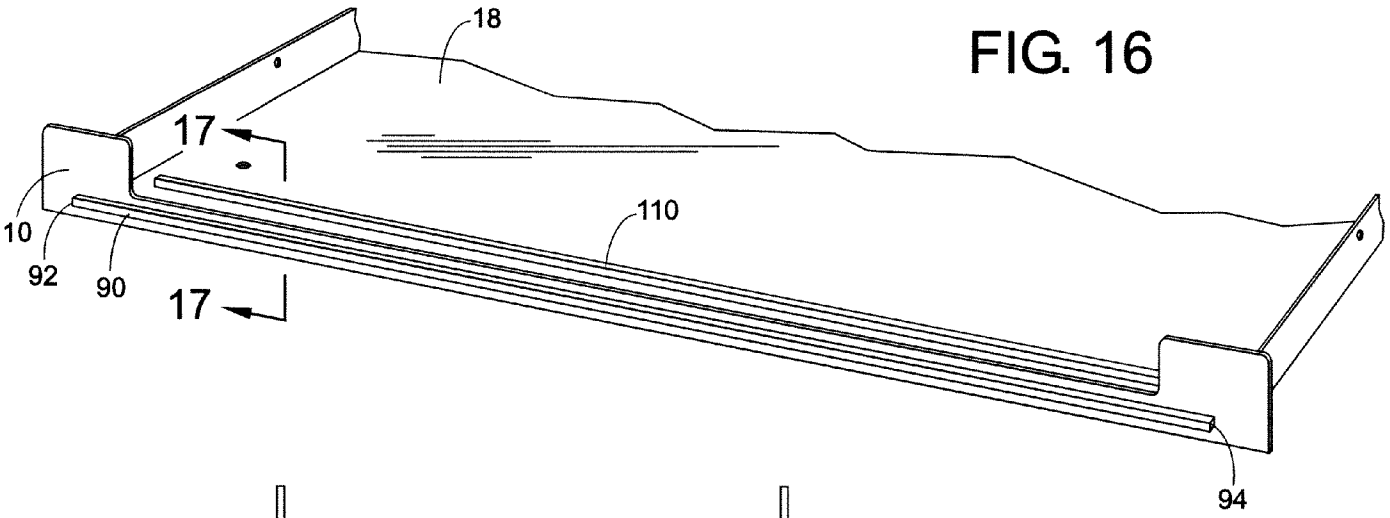
FIG. 16 is a front perspective view of an alternate embodiment of the tray having a square-shaped reinforcement rib on a front wall and bottom wall of the tray.

Referring now to FIG. 16, in accordance with another aspect of the disclosure, a reinforcement rib 90 is formed on front wall 10 which has straight or flat opposite edges 92, 94. The rib itself can be rounded as shown in FIG. 7, angled as shown in FIG. 13 or square-shaped as shown in FIG. 17.

Figure 17:
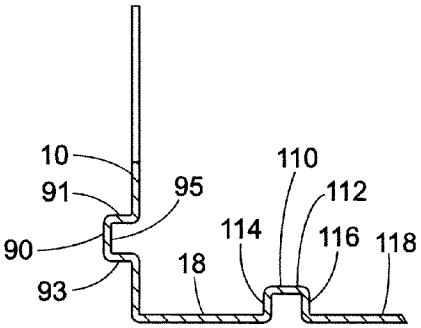
FIG. 17 is a cross-sectional view along lines 17-17 of FIG. 16.

Referring to FIG. 17, rib 90 has a square-shaped cross-section formed by walls 91, 93, 95. Horizontal walls 91 and 93 extend along the longitudinal length of the front wall and are substantially parallel to each other. Vertical wall 95 extends between walls 91 and 93 and is substantially parallel to front wall 10. Rib 90 extends outwardly of front wall 10.

A second reinforcement rib 110 may be formed in bottom wall 18. Rib 110 is substantially parallel to rib 90. As seen in FIG. 17, rib 110 includes horizontal wall 112 which is substantially parallel to bottom wall 18 and vertical parallel walls 114, 116 which are formed on opposite ends of wall 112. Walls 114, 116 extend along a longitudinal length of wall 18. In FIG. 17, the rib 110 extends above upper surface 118 of bottom wall 18.

Figure 18:
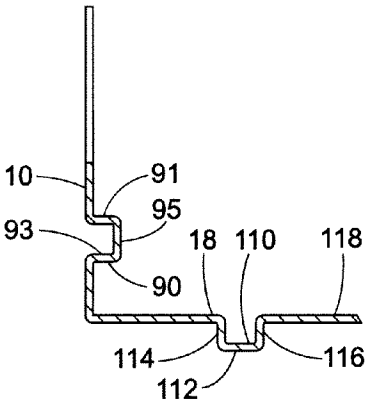
FIG. 18 is a cross-sectional view of an alternate embodiment of the tray with square-shaped reinforcement ribs.

An alternate embodiment is shown in FIG. 18. In FIG. 18, walls 91, 93 and 95 extend inwardly with respect to front wall 10, and walls 112, 114, 116 extend below the upper surface 118 of wall 18. Any combination of ribs shown in FIGS. 17 and 18 are contemplated by the disclosure.

Figure 19:
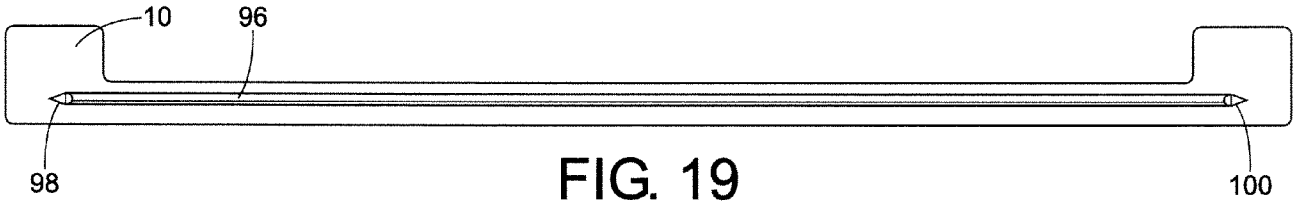
FIG. 19 is a front view of a tray with angled or tapered opposite ends.

Referring now to FIG. 19, in accordance with another aspect of the disclosure, a rib 96 is formed on front wall 10 and has angled or tapered opposite edges 98, 100. Rib 96 can be rounded as shown in FIG. 7 or angled in appearance as shown in FIG. 13.

Figure 20:
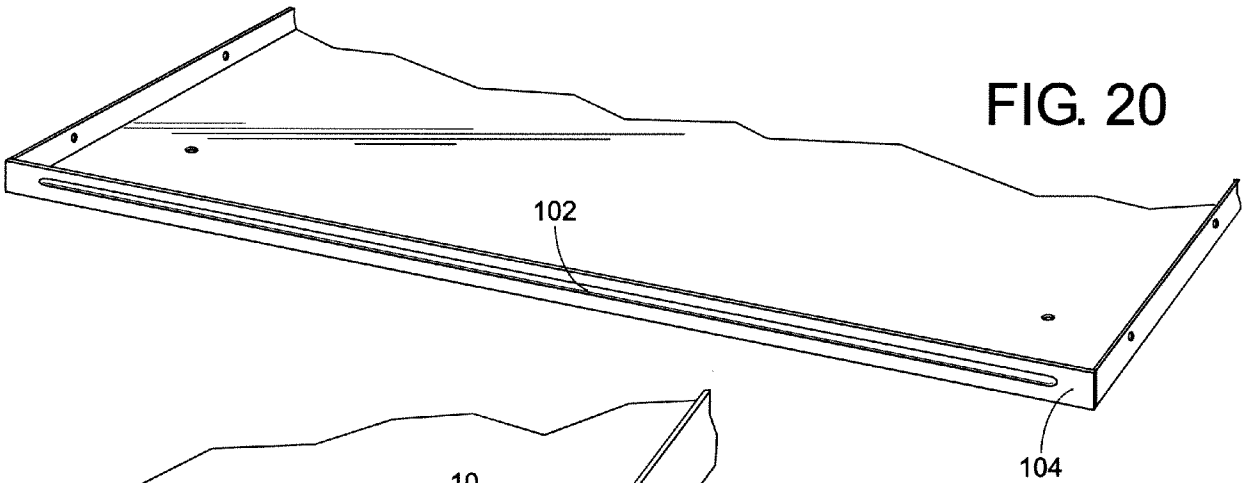
FIG. 20 is a perspective view of a tray with a front wall with an elongated rib formed thereon and without ears in accordance with another embodiment of the disclosure.

Referring now to FIG. 20, in accordance with another aspect of the disclosure, a curved or angled reinforcement rib 102 is formed on a front wall 104 which does not have ears such as ears 20, 22 of FIG. 2.

Figure 21:
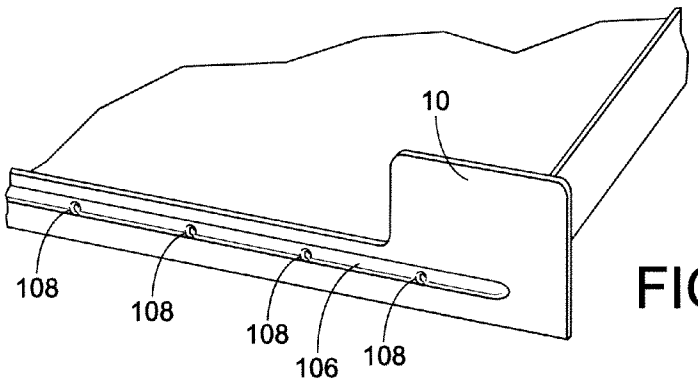
FIG. 21 is a front view of a rib with dimples formed therein in accordance with another alternate embodiment.

Referring now to FIG. 21, in accordance with another aspect of the disclosure, a reinforcement rib 106 can have a plurality of depressions or dimples 108 formed along a longitudinal length of the rib. Again, rib 106 can be curved as shown in FIG. 7 or tapered as shown in FIG. 13 or square-shaped as shown in FIG. 17.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the above description and appended claims or the equivalent thereof.

The invention claimed is:

1. A slidable tray for use with storage cabinets consisting of:

a front wall, a pair of side walls, a rear wall, and a bottom wall connecting said front wall, said pair of side walls, and said rear wall, wherein said walls form a cavity of said tray;

wherein said front wall consists of flanges extending upwardly from opposite ends of said front wall, and only a single first reinforcement member integrally formed with and extending longitudinally across said front wall and into said flanges;

wherein said first reinforcement member consists of a rib extending from said front wall, wherein said rib consists of a first horizontal portion, a second portion and a third portion wherein said second portion and said third portion extend in opposite directions from said first horizontal portion into said flanges of said front wall and each of said second and third portions extends upwardly at an angle with respect to said first horizontal portion wherein said angles extend in opposite directions wherein said first, second, and third portions of said rib protrude outwardly or inwardly from said front wall; and a single second reinforcement member consisting of a rib extending longitudinally from said bottom wall and protruding inwardly or outwardly from said bottom wall, wherein said first reinforcement member and said second reinforcement member are spaced apart and do not contact each other and are oriented 90 degrees with respect to each other.

2. The tray of claim 1, wherein said first reinforcement member is about ⅛ inch wide by ⅛ inch deep.

3. The tray of claim 1, wherein said rib of said first reinforcement member has a semi-circular portion having a radius of about ⅛ inch extending along a longitudinal length of said first reinforcement member.

4. The tray of claim 3, wherein said first reinforcement member has opposite ends each having a curved wall.

5. The tray of claim 1, wherein said second reinforcement member extends along a longitudinal length of said bottom wall.

6. The tray of claim 5, wherein said second reinforcement member is substantially parallel to said first reinforcement member.

7. The tray of claim 6, wherein said first reinforcement member extends outwardly from said front wall.

8. The tray of claim 6, wherein said second reinforcement member extends above a top surface of said bottom wall.

9. The tray of claim 6, wherein said first reinforcement member extends inwardly into said front wall.

10. The tray of claim 6, wherein said second reinforcement member extends below a top surface of said bottom wall.

* * * * *